US011609062B1

(12) United States Patent
O'Loughlin

(10) Patent No.: US 11,609,062 B1
(45) Date of Patent: Mar. 21, 2023

(54) ARROW REST MOUNTING SYSTEM

(71) Applicant: Vapor Trail Inc., Ham Lake, MN (US)

(72) Inventor: Rory O'Loughlin, Orono, MN (US)

(73) Assignee: Vapor Trail Inc., Ham Lake, MN (US)

( * ) Notice: Subject to any disclaimer, the term of this patent is extended or adjusted under 35 U.S.C. 154(b) by 15 days.

(21) Appl. No.: 17/527,395

(22) Filed: Nov. 16, 2021

(51) Int. Cl.
*F41B 5/22* (2006.01)
*F41B 5/14* (2006.01)

(52) U.S. Cl.
CPC ..... *F41B 5/143* (2013.01)

(58) Field of Classification Search
CPC ..... F41B 5/143
See application file for complete search history.

(56) References Cited

U.S. PATENT DOCUMENTS 5,285,764 A * 2/1994 Mertens ..... F41B 5/1438 124/44.5
6,178,959 B1 * 1/2001 Troncoso, Jr. ..... F41B 5/143 124/44.5
7,219,662 B1 * 5/2007 Henry ..... F41B 5/143 124/44.5
8,967,131 B2 * 3/2015 Hunt ..... F41B 5/143 124/44.5
9,151,567 B1 * 10/2015 Estridge ..... F41B 5/143
11,105,581 B2 8/2021 Summers et al.

* cited by examiner

*Primary Examiner* — John A Ricci
(74) *Attorney, Agent, or Firm* — Warner Norcross + Judd LLP

(57) ABSTRACT

An arrow rest mounting system is provided including a primary mount mountable to an archery bow riser with a riser fastener, and a secondary mount vertically, movably joined with the primary mount. The secondary mount can extend over and conceal the riser fastener. A vertical micro adjuster can provide selective vertical adjustment of the secondary mount relative to the primary mount. A horizontal micro adjuster can extend from the secondary mount, can be joined with an arrow rest support including a support arm movable from a support position to a rest position, and can provide selective horizontal adjustment of the support arm. The vertical micro adjuster can be forward of the riser fastener, and the horizontal micro adjuster can be rearward of the riser fastener to fit the mounting system in a tight space. A related method of use is provided.

20 Claims, 8 Drawing Sheets

ARROW REST MOUNTING SYSTEM

BACKGROUND OF THE INVENTION

The present invention relates to an archery arrow rest and a related mounting system.

Most archery bows are equipped with an arrow rest that supports an arrow before it is shot from the bow. One common arrow rest is referred to as a "drop away" arrow rest. This rest precisely and accurately positions the arrow when the bow (and thus, the bowstring) is at full draw. This rest also drops rapidly away from the arrow after a predetermined amount of travel of the arrow over the rest upon release of the bowstring. Accordingly, the rest does not contact the arrow for its full length, and also does not contact the arrow's fletching to divert the arrow from an intended trajectory as the arrow is shot from the bow.

An important feature of the modern arrow rest is the exact position of the arrow rest relative to the riser, and thus to the travel path of the arrow while the arrow is still nocked to the bowstring. This position affects the amount of time the rest contacts the arrow, as well as the eventual trajectory of the arrow after it disengages the bowstring during the shot. With the increased number of high performance features on archery bows, more archers require precision settings to fine tune the elevation and windage of an arrow rest mounted on a bow.

Many conventional arrow rests, however, fall short of providing consistent and reproducible adjustment settings. For example, most rests come with a mounting bracket having an elongated slot through which a screw is placed to fasten the bracket to a riser of the bow. To adjust the rest, toward or away from the riser, a user loosens the screw and pushes or pulls the rest. Sometimes during this movement, however, the rest rotates about the screw angularly, which can move the rest up or down. As a result, a simple linear adjustment in one direction alters the angular or vertical orientation of the rest as well. This can further affect the precise movement of any vertical or horizontal adjustment mechanisms further included on the rest.

In addition, some archery bows are configured so that it is difficult to place an archery rest close enough to the riser and further include a functional elevation adjustment mechanism. In particular, there can be too little space available between the riser and the rest. In such a case, some manufacturers simply delete the elevation adjustment mechanism, which can limit the adjustability of the rest, and might not provide the amount of fine tuning that some archers desire.

Accordingly, there remains room for improvement in the construction of arrow rests to provide fine tune vertical and horizontal adjustment within the confines or limited spaces on some archery bows.

SUMMARY OF THE INVENTION

An arrow rest mounting system is provided including a primary mount mountable to an archery bow riser with a riser fastener, and a secondary mount vertically, movably joined with the primary mount.

In one embodiment, the rest can include a vertical micro adjuster that provides selective vertical adjustment of the secondary mount relative to the primary mount. The rest can further include a horizontal micro adjuster joined with an arrow rest support, having a support arm movable from a support position to a rest position. This adjuster can provide selective horizontal adjustment of the support arm.

In another embodiment, the vertical micro adjuster can be forward of the riser fastener, and the horizontal micro adjuster can be rearward of the riser fastener to fit the mounting system in a tight space relative to an archery bow riser.

In still another embodiment, the secondary mount can extend over and conceal the riser fastener. The primary mount can define a riser fastener hole including an enlarged portion within which a head of the riser fastener nests. The secondary mount can cover and conceal the head of the riser fastener.

In yet another embodiment, the primary mount can include a vertical axis. The secondary mount can be selectively slidable relative to the primary mount along the vertical axis. The vertical axis can be substantially parallel to a plan in which a bowstring of an archery bow to which the rest is attached moves. The vertical micro adjuster can provide selective vertical adjustment of the secondary mount relative to the primary mount parallel to the vertical axis defined by the primary mount and/or generally parallel to the bowstring plane.

In even another embodiment, the primary mount can define a first vertical fastener hole. The secondary mount can define a second vertical fastener hole aligned with the first vertical fastener hole. A vertical fastener can extend through the second vertical fastener hole and into the first vertical fastener hole. The vertical fastener can be slidable linearly relative to the second fastener hole to adjust a vertical position of the secondary mount relative to the primary mount with the vertical micro adjuster.

In a further embodiment, the vertical micro adjuster can include a first threaded fastener rotatably mounted to the secondary mount. The primary mount can define a first registration hole. A first guide can be mounted on the first threaded fastener and registered in the first registration hole. Rotation of the first threaded fastener can move the first guide along the first threaded fastener, thereby translating the secondary mount up or down relative to the primary mount to adjust the vertical disposition or elevation of the arrow rest along the vertical axis and vertically relative to the primary mount.

In still a further embodiment, the horizontal micro adjuster can include a second threaded fastener rotatably mounted to the secondary mount, distal from the first threaded fastener. A second guide can be mounted on the second threaded fastener. Rotation of the second threaded fastener can move the guide along the second threaded fastener, thereby translating the arrow rest support left or right relative to the primary mount to adjust windage or the horizontal disposition of the arrow rest relative to the primary mount and/or the bow riser.

In yet a further embodiment, a method of mounting an arrow rest mounting system to an archery bow is provided. The method can include mounting a primary mount to an archery bow riser with a riser fastener, and mounting a secondary mount to the primary mount so that a vertical micro adjuster is disposed forward of the riser fastener. Optionally, a horizontal micro adjuster is disposed rearward of the riser fastener.

The arrow rest mounting system of the current embodiments provides a simple and efficient mechanism to support a ready to shoot arrow relative to a bow, and yet provide adequate, fine tune adjustments to the horizontal and vertical orientation of the arrow rest relative to the riser to which it is mounted. The system is well suited for archery bows with risers and features with minimal space to mount an arrow rest. When the vertical micro adjust is included and mounted forward of the riser fastener, the mounting system consumes little volume and yet fits most archery bows, still providing desired elevation or vertical adjustments in fine increments.

These and other objects, advantages and features of the invention will be more readily understood and appreciated by reference to the detailed description of the invention and the drawings.

Before the embodiments are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 6:
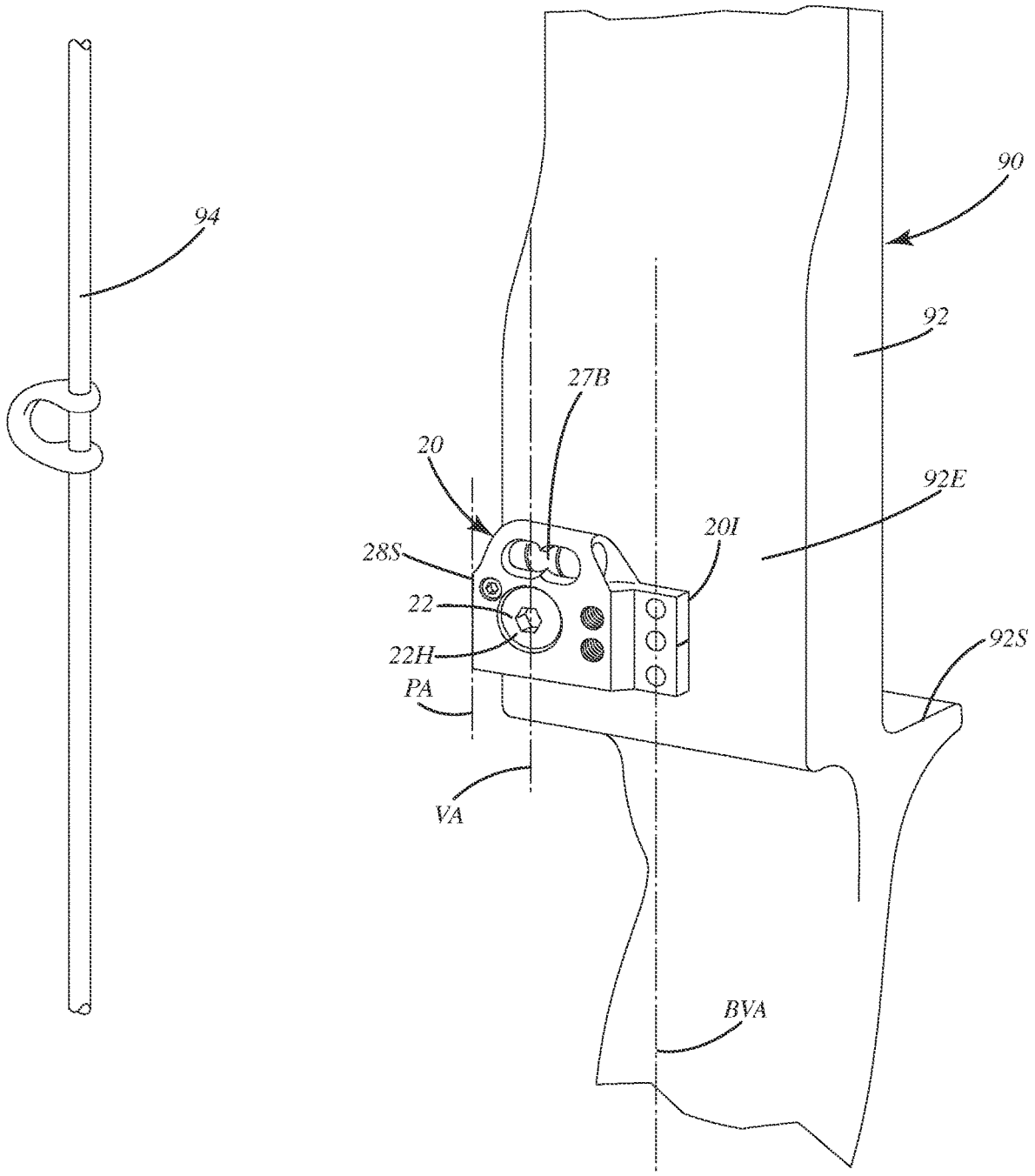
FIG. 6 is a side view of the primary mount being mounted on an archery bow riser with a riser fastener.
Figure 7:
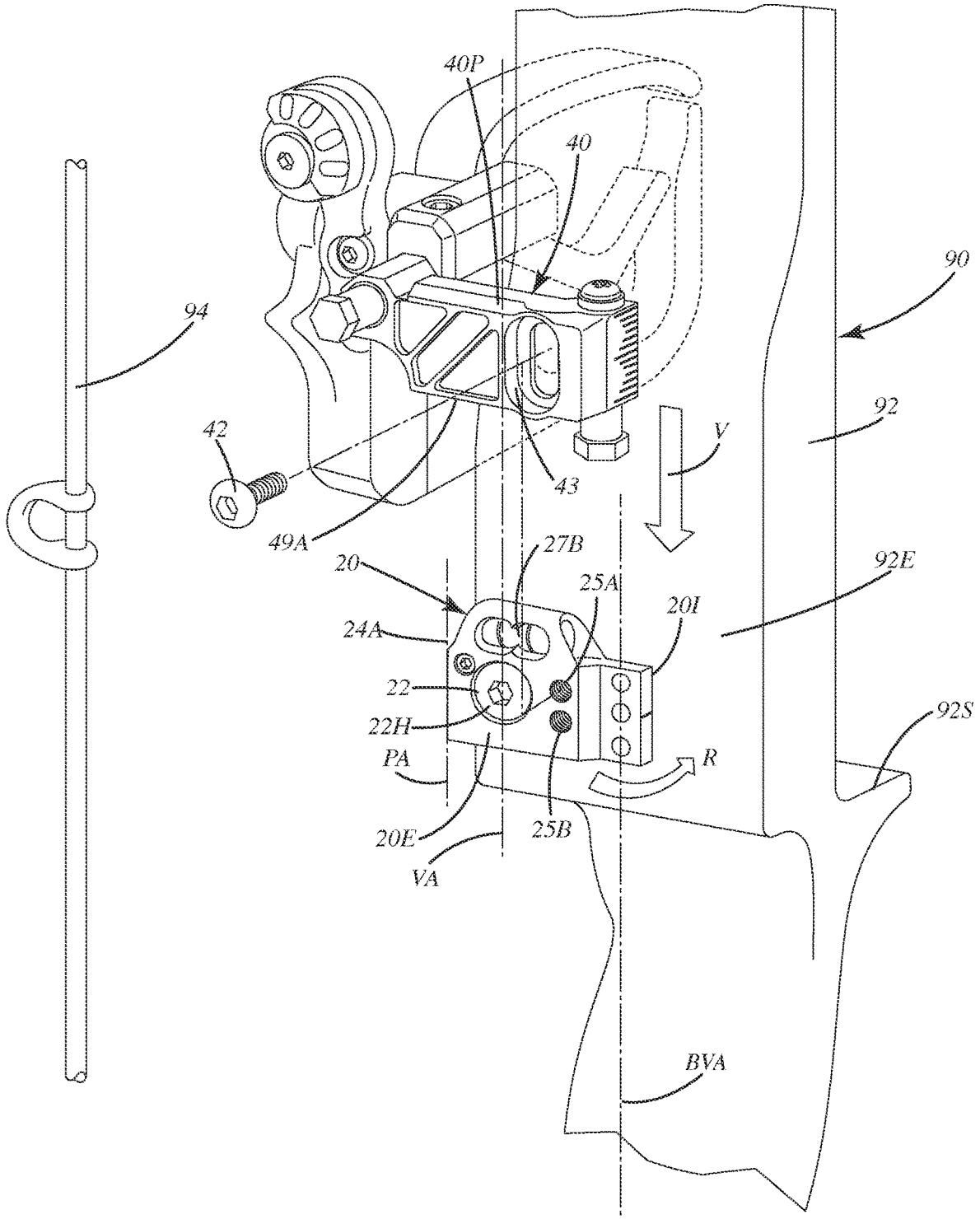
FIG. 7 is a side view of the secondary mount being initially mounted to the primary mount.
Figure 8:
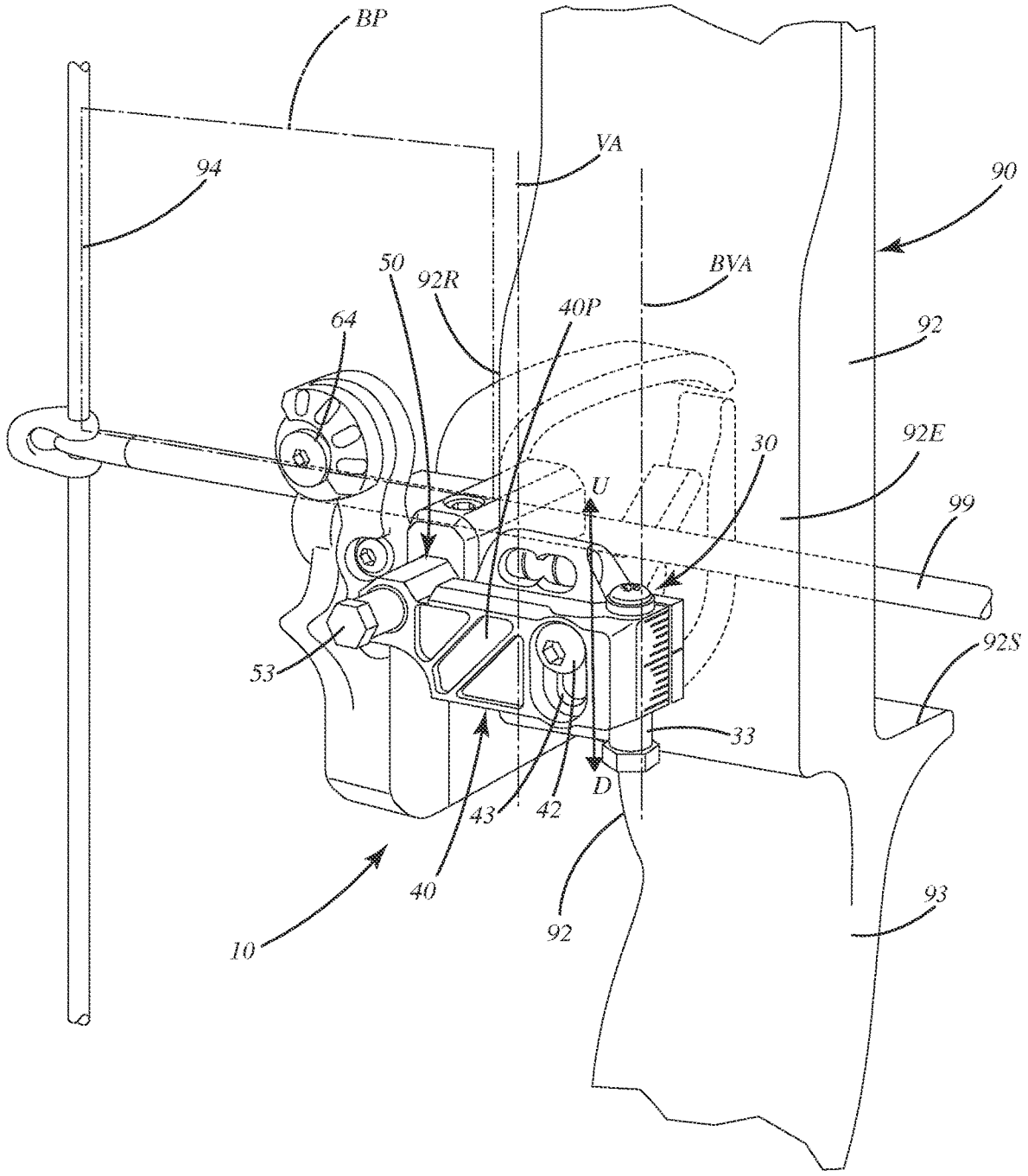
FIG. 8 is a side view of the secondary mount being fully mounted to the primary mount.

An arrow rest mounting system constructed in accordance with a current embodiment is illustrated in FIGS. 1-8 and generally designated 10. The arrow rest mounting system 10 can be joined with a bow 90, and in particular, a bow riser 92, as shown in FIG. 8. The arrow rest mounting system 10 can include a primary mount 20 and a secondary mount 40. The primary mount 20 can be secured directly to the riser 92 via a riser fastener 22 that is threaded into a corresponding threaded hole 92H defined by the riser 92, sometimes referred to as a Berger hole. The secondary mount 40 can include a vertical micro adjuster 30 mounted forward F of the riser fastener 22 and its corresponding riser fastener hole 23. The secondary mount 40 also can include a horizontal micro adjuster 50 that can be mounted rearward B of the riser fastener 22 and the corresponding riser fastener hole 23. When the secondary mount 40 is fully installed relative to the primary mount 20, the base 40P, which can be in the form of a plate, of the secondary mount 40 can partially or fully conceal and cover the riser fastener hole 23 as well as the riser fastener 22 as described below.

The secondary mount 40 can be joined with an arrow rest support 60 that is further joined with a support arm 62. The support arm 62 can engage and support an arrow 99 that is nocked on the bowstring 94, as shown in FIG. 8. There, the support arm 62 is in the support position when the arrow 99 is ready to shoot. Although not shown, the support arm 62 can drop out of the way as the arrow 99 is shot. The support arm 62 can be coupled to an actuator or redirection element 64, which can further be coupled to a cable, limb, limb axle or other component of the archery bow to actuate the support arm, moving it from a support position to a dropped position so that the support arm 62 is moved out of the way from interfering with the trajectory of the arrow 99 as it is shot from the bow 90.

Figure 1:
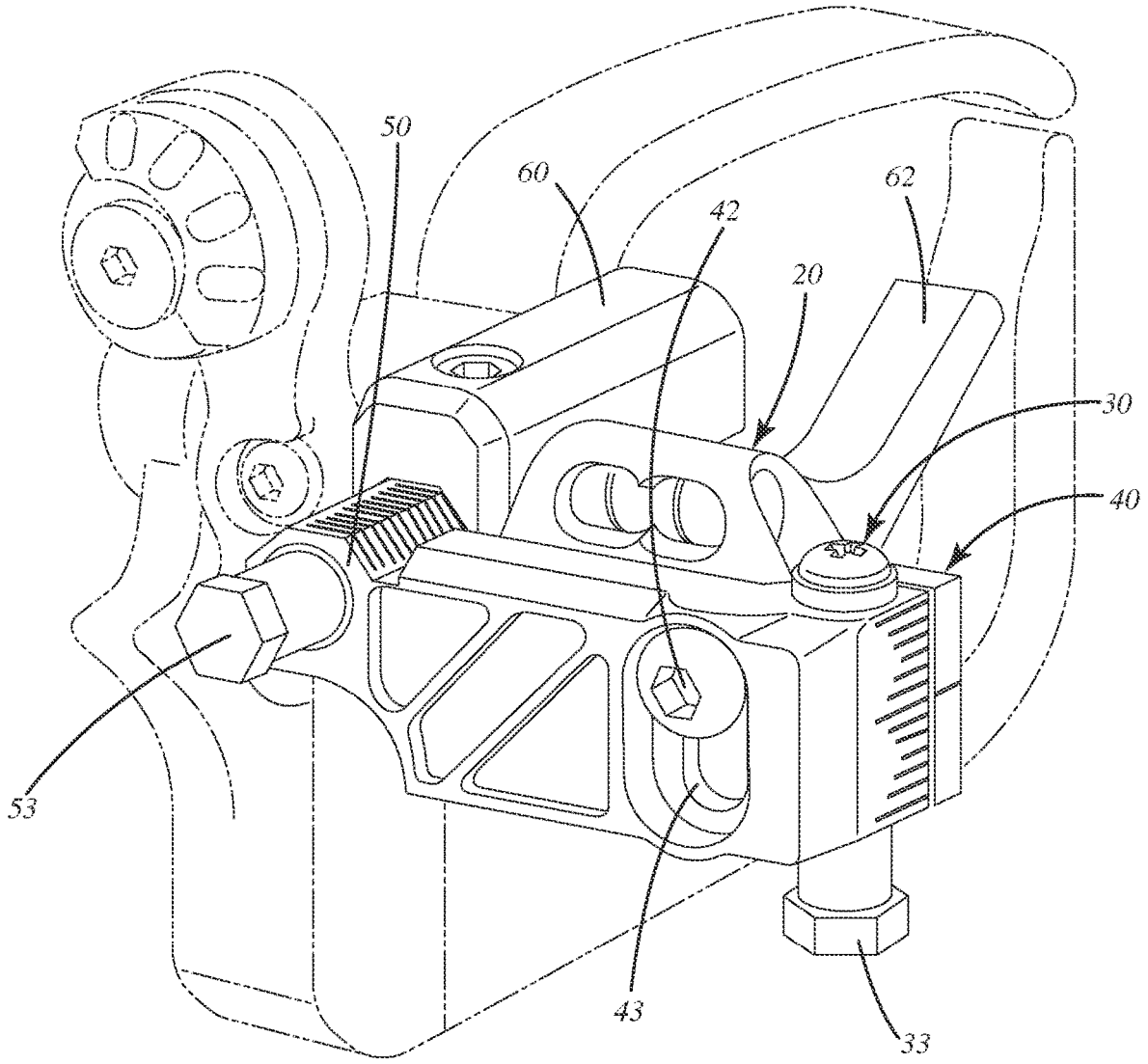
FIG. 1 is a perspective view of an arrow rest including an arrow rest mounting system of a current embodiment.

For purposes of disclosure, the arrow rest mounting system 10 is described in connection with an archery bow, however the system is well suited for use with any other type of projectile shooting device. As shown in FIG. 1, the system 10 mounts the support arm 62 above a handle or grip 93 of the bow in a location corresponding to the center of the bowstring 94. Although described in connection with a drop away arrow rest, the arrow rest mounting system can be used with any type of arrow rest. Further, the mounting system can be used to mount any other type of device or component to an archery bow, for example a riser of an archery bow.

As mentioned above, the mounting system 10 can include a primary mount 20 that can be directly fastened to the archery bow riser 92 via a riser fastener 22. The secondary mount 40 can be selectively and moveably mounted to the primary mount 20, and can provide independent vertical and horizontal adjustments to the support arm 62 relative to the bowstring plane BP. The primary mount 20 can be an independent component or part, separately constructed from the secondary mount 40. Each of these mounts, can be constructed from a similar material, such as a metal, composites, polymers or combinations of the foregoing. Each of these mounts can be molded, cast, machined, 3D printed or otherwise manufactured according to various techniques.

Figure 3:
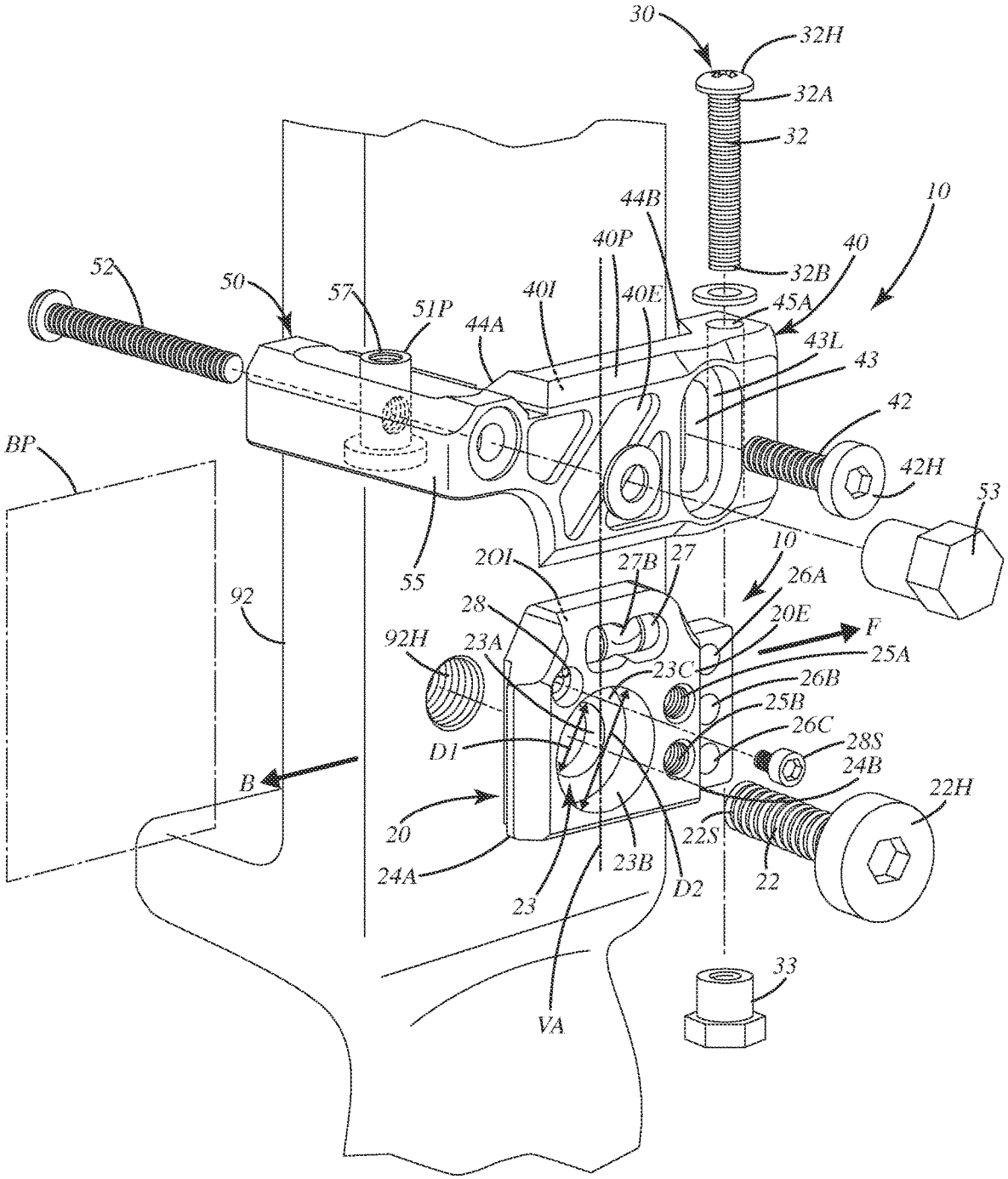
FIG. 3 is an exploded view front view of the arrow rest mounting system primary and secondary mounts.
Figure 4:
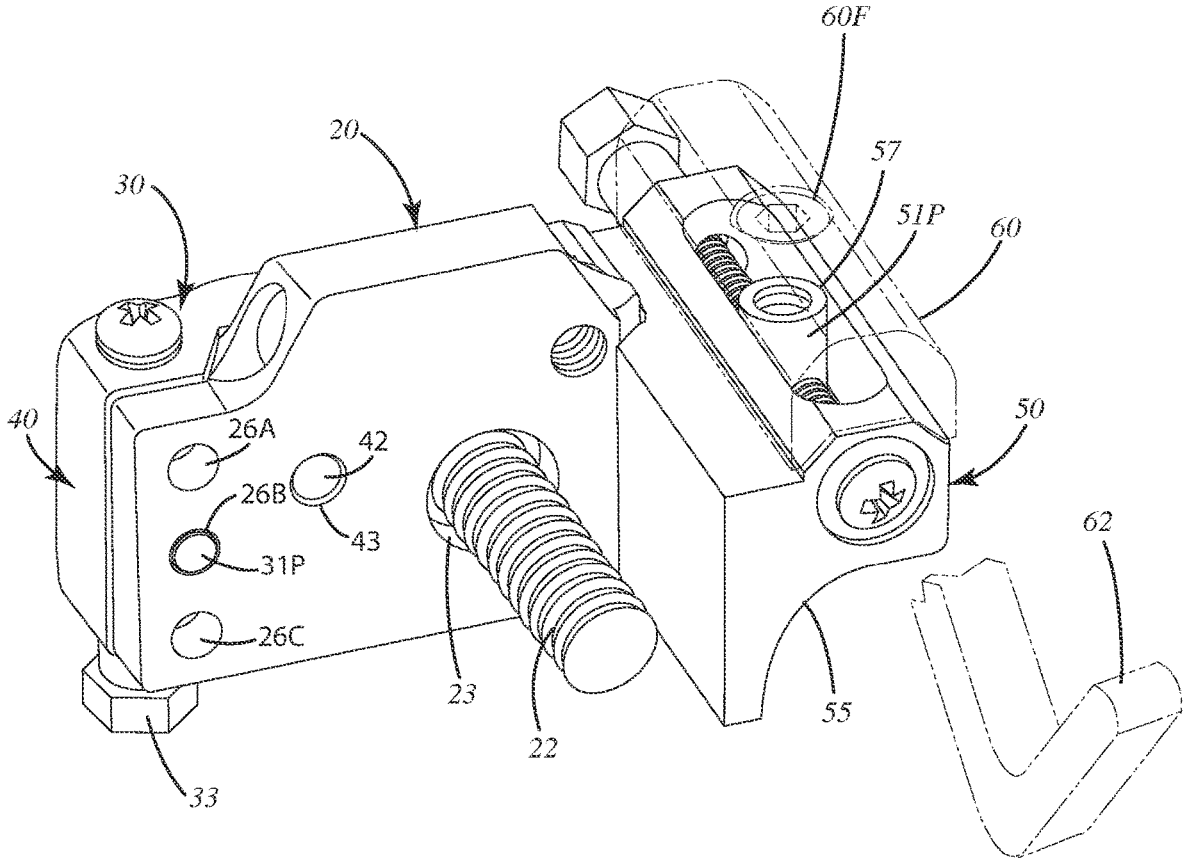
FIG. 4 is a perspective rear view of the arrow rest mounting system.
Figure 5:
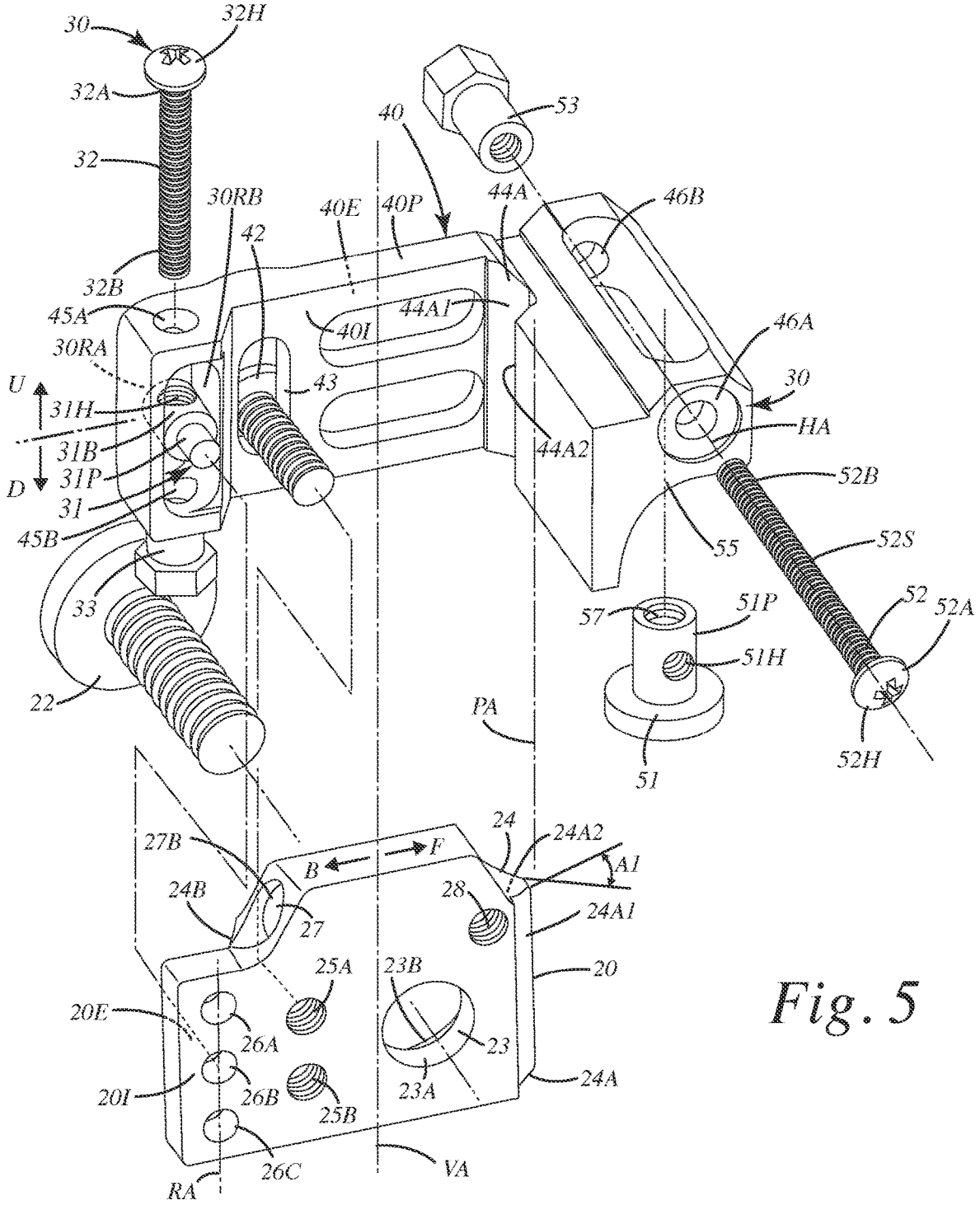
FIG. 5 is an exploded rear view of the arrow rest mounting system primary and secondary mounts.

As shown in FIGS. 3-5, the primary mount 20 will be described in more detail. In particular, the primary mount 20 can include a vertical axis VA. This vertical axis VA can be aligned with and substantially parallel to the bowstring plane BP of the archery bow to which the bonding system 10 is secured. This vertical axis VA also can be aligned with and substantially parallel to a vertical riser or bow axis BVA, which itself can be parallel to and/or aligned with the bowstring plane BP.

The primary mount 20 can include a primary mount exterior surface 20E and a primary mount interior surface 201. The primary mount interior surface 201 can be placed against the riser 92 as shown in FIG. 8. In most cases, the primary mount interior surface 201 can be in direct engagement with the riser exterior or lateral surface 92E, which is opposite the shelf 92S of the riser 92, when the mounting system 10 is mounted to the bow. When so mounted, the vertical axis VA of the primary mount 20 can be substantially parallel to the bow vertical axis BVA which itself can be substantially parallel to a bowstring plane BP in which the bowstring 94 moves.

The primary mount 20 can include one or more guides 24A and 24B. These guides 24A and 24B can be disposed at the respective rearward and forward portions of the primary mount 20. These guides can be registered with and can selectively move relative to corresponding guides 44A and 44B associated with the secondary mount 40. As shown, the guide 24A can be in the form of a first rail. This first rail 24A can slidably engage a guide recess 44A defined by the secondary mount 40. As shown, the first rail can be slidably registered within the guide recess 44A. Both of these elements can be parallel to the vertical axis VA of the primary mount. Optionally, the first rail can have a convex contour, optionally in the form of a ridge. The ridge can be angular or rounded. The ridge can have opposing laterally facing surfaces 24A1 and 24A2. These surfaces can fit within and can engage adjacent corresponding surfaces 44A1 and 44A2 of the recess 44A. The surfaces 24A and 24B can be disposed at an angle A1 relative to one another. This angle A1 can be an acute angle, but of course, other angles can be selected, such as right angles or obtuse angles, depending on the desired movement and retention between the secondary mount 40 and the primary mount 20.

The other guide 24B can be in the form of a slanted, angled or rounded surface. The corresponding guide recess or surface 44B can be of a similar angle and/or contour. The rearward guide recess 44A can be configured to trap the first rail 24A within it. The forward guide recess 44B, however, can be open sided so that it does not effectively trap the guide surface 24B within it. Thus, the rearward part of the primary mount 20, that is the rail 24A can be trapped within the guide recess 44A, but the forward part of the primary mount 20, that is, the forward guide 24B, can be free relative to the guide recess 44B, and can merely rest against it. This freedom of movement of the forward guide 24B can allow the secondary mount 40 to be tilted or rotated inward relative to the primary mount as described below. In the area near the guide 24B, the forward portion 40F of the secondary mount 40 can be secured to the primary mount 20 via a vertical fastener 42 disposed through a hole 43 and into one or more of respective threaded holes 25A or 25B defined by the primary mount 20.

As mentioned above, and shown in FIGS. 3-5, the primary mount 20 can define a riser fastener hole 23 which can be configured to receive the riser fastener 22. The riser fastener hole 23 can include a first portion 23A and a second portion 23B. The first portion 23A can be sized to receive a shaft 22S of the riser fastener 22 there through. That shaft 22S can be threaded so that it can thread into a hole defined by the lateral side 92E of the riser 92. The second portion 23B can be sized to receive a head 22H of the fastener 22. As an example, the first portion 23A can be in the form of a circular or cylindrical opening having a diameter D1. This diameter D1 can be less than a diameter D2 of the second portion 23B, which again is sized to receive the shaft 22S. Between the first portion and the second portion, a ledge or shelf 23C can be formed. The head 22H of the fastener 22 can engage and can be urged against this shelf 22C to exert a force against the primary mount 22, thereby drawing it against the riser when the mounting system is installed. Optionally, although shown as round or circular apertures, the portions of the hole 23A and 23B can be in the form of elongated slots having a long axis that is parallel to the vertical axis VA or optionally perpendicular thereto for vertical and horizontal adjustment of the primary mount 20 relative to the bow riser 92.

The primary mount 20 can define a first vertical fastener hole 25A and a third vertical fastener hole 25B. These holes can be aligned one over the other. These holes can provide different vertical placement of the secondary mount 40 relative to the primary mount 20, and subsequently relative to the riser to macro adjust the support arm 62 vertically. These holes 25A and 25B can be aligned with the second vertical fastener hole 43 that is defined by the secondary mount. This second vertical adjustment hole 43 can be in the form of an elongated slot that extends parallel to the vertical axis VA. When the secondary mount 40 is installed relative to the primary mount 20, the vertical fastener 42 can extend through the slot 43 and into one of the holes 25A or 25B. Again, depending on the desired vertical disposition of the secondary mount relative the primary mount, either of the holes 25A or 25B can be selected. The slot 43 can allow for additional vertical adjustment by moving the fastener relative to the slot, up or down within it. As explained below, this vertical fastener 42 can be loosened or threaded out from the holes 25A or 25B, in which case, the head of the vertical fastener no longer clamps against the secondary mount 40, such that the vertical micro adjuster 30 can be operated to adjust the vertical position of the secondary mount 40 relative to the primary mount 20.

With reference to FIGS. 3 and 5, the primary mount 20 can further define one or more registration holes 26A, 26B and 26B. These registration holes can be configured to receive a first guide 31 of the vertical micro adjuster 30. As shown, there can be one, two, three or more registration holes defined by the primary mount. The registration holes can be defined along a registration hole axis RA that can be generally parallel to the vertical axis VA of the primary mount. The first guide 31 can include a pin 31P that optionally can be of a cylindrical shape so that it can fit within one of the vertically oriented holes 26A, 26B or 26C, depending on the relative vertical adjustment and placement of the secondary mount 40 relative to the primary mount 20 as described below.

The primary mount 20 optionally can define a bubble level aperture 27 within which a bubble level 27B can be disposed. This bubble level can be a fluid-filled bubble level including a bubble that is used to assist in leveling the primary mount relative to the vertical axis and/or a perpendicular horizontal axis, the bow vertical axis PVA and/or the bowstring plane BP, depending on the application. Further optionally, the primary mount 20 can include a set screw hole 28 within which a set screw 28S can be threaded. The set screw 28S can be screwed into the hole 28 and can engage the riser 92 to prevent rotation of the primary mount 20 relative to the riser and/or to set the relative position of the primary mount relative to the riser in a fixed configuration after the riser fastener is secured in place to secure the mount 20 against the riser.

Turning now to FIGS. 2-5, as mentioned above, the mounting system 10 includes the secondary mount 40 that is selectively, slidably mounted to the primary mount 20. This secondary mount can be set in a fixed vertical position relative to the primary mount 20 via a vertical fastener 42. Generally, the secondary mount 40 can be selectively slidable relative the primary mount along the vertical axis VA when the primary mount is secured to the archery bow riser. The secondary mount, for example the base or plate 40P, can extend over and conceal over all or a portion of the riser fastener 22, and in particular the riser fastener head 22H. The secondary mount further can extend over and conceal all or a portion of the riser fastener hole, including the large portion 23B near the exterior 20E of the primary mount. In this case, the interior 401 of the secondary mount 40 can face toward and can be adjacent the riser fastener 22 and the riser fastener hole 23.

The sliding or movement of the secondary mount relative to the primary mount can be guided by the respective guide 24A registered in the guide recess 44A, as well as the surfaces 24B and 44B interfacing and sliding relative to one another. Optionally however, these elements and guides do not secure the secondary mount 40 directly to the primary mount 20. As shown, the vertical fastener 42 extending through the slot 43 and into at least one of the vertical fastener holes 25A and 25B of the primary mount can be the structure that secures the secondary mount 40 to the primary mount 20. When installed, the vertical fastener 42 can be tightened such that the head 42H engages the ledge or shoulder 43L of the vertical fastener hole 43. The vertical fastener 42 can further extend into one of the associated holes 25A or 25B in the primary mount. When the fastener is fully installed, the head 42H can clamp against the ledge 43 and pull the secondary mount against the primary mount such that the interior surface 401 mates or clamps against the exterior surface 20E of the primary mount. When this vertical fastener 42 is tightened, the vertical micro adjuster 30 optionally cannot provide vertical adjustment of the secondary mount, moving it relative to the primary mount. Of course, when the vertical fastener 42 is loosened relative to the holes for 25A or 25B, and the hole 43 slightly, the vertical micro adjuster 30 can be operated to provide upward U or downward D vertical movement or elevation adjustment of the secondary mount 40 relative to the primary mount as described below. When this occurs, the head 42H can slide along the ledge 43L generally within the hole or slot 43 until the appropriate vertical adjustment is achieved. Then, the user can tighten the vertical fastener 42 and fixedly secure the secondary mount 40 relative to the primary mount 20 so that no further up or down movement can be achieved with the vertical micro adjuster 30.

Turning now to the vertical micro adjuster 30, this component can be formed in a forward portion 40F of the secondary mount 40. As shown in FIG. 5, the vertical micro adjuster 30 can be disposed and/or joined with the secondary mount forward of the riser fastener 22 and the associated riser fastener hole 23. As mentioned above, the secondary mount can include a forward portion 40F and a rearward portion 40R. The forward portion 40F can face forward when the primary mount is mounted to the archery bow 90. The rearward portion 40R can face rearward, toward a user drawing the archery bow when the mounting system 10 is mounted to the archery bow. The forward portion 40F can be forward of the riser fastener and the riser fastener hole, as well as the vertical fastener 42 and the vertical fastener hole 43, as well as the other vertical hole fasteners 25A and 25A in the primary mount. The rearward portion 40R of the secondary mount 40 can be disposed rearward B of the riser fastener 22, riser fastener hole 23 as well as the vertical fastener 42 and vertical fastener holes 43, 25A and 25B.

When installed relative to the primary mount 20, the vertical micro adjuster 30 can extend forward F of the vertical axis VA of the primary mount. With the vertical micro adjuster 30 so disposed, the arrow rest support 60 and support arm 62 can be mounted closer to the bow riser 92 because there is no additional vertical micro adjuster disposed between the support 60 and the riser fastener 22.

With further reference to FIG. 5, the vertical micro adjuster 30 can be integrated into the secondary mount in the forward portion 40F. The adjuster 30 can include a first threaded fastener 32 having a first end 32A and a second end 32B. The first end 32A can include a head 32H which can further define a drive feature for a tool. The second end 32B can be joined with a control knob 33, which can be manually actuated by a user, optionally via rotation of the knob. The first end 32A of the fastener 32 can extend through an aperture 45A defined by the secondary mount. The second end 32B can extend through a second aperture 45B defined by the secondary mount distal from the first aperture 45A. The fastener 32 and the respective ends can be rotatable within and relative to the first of second apertures 45A and 45B. The fastener 32 can extend through the apertures 45A and 45B and can rotate freely relative to those apertures, optionally not being threaded within those apertures.

The vertical micro adjuster 30 can include a first guide 31 that interfaces with the fastener 32. The first guide 31 can be slidably registered in and with an elongated recess 30R that is disposed between the first and second apertures in the secondary mount. This elongated slot can guide walls 30RA and 30RB. The first guide 31 can include a base 31B which can be disposed between and slide relative to each of the respective sidewalls 30RA and 30RB. A post or pin 31P can project from the base. This post 31P can define a hole 31H through which the fastener 32 projects. The fastener hole 31H can be threaded and can receive the shaft of the fastener. The post 31P of the first guide 31 can project outwardly from the recess 30R generally from the interior surface 401 secondary mount.

The post 31P can be selectively disposed in any one of the vertical adjustment registration holes 26A-26C, depending on a desired vertical placement of the secondary mount relative to the primary mount. When so registered in a hole, the post can facilitate relative movement of the secondary mount 40 relative to the primary mount 20. For example, when the fastener 32 is rotated by a user engaging the control knob 33, the fastener freely rotates relative to the fastener holes 32A and 32B. However, because the fastener is threaded and engages the hole 31H of the guide 31, the fastener moves relative to the post 31P, which again is registered to one of the preselected holes 26A-26C. As a result, the secondary mount 40 moves in direction up U or direction down D relative to the primary mount 20, generally along the vertical axis VA of the primary mount 20. Accordingly, the rotational movement of the fastener is translated to the guide 31, which translates to linear movement of the secondary mount up U or down D along the vertical axis VA and relative to the primary mount 20.

As noted above, the vertical micro adjuster 30 can be mounted forward of the vertical fastener, the riser fastener and the respective holes thereof. The first fastener 32, first post 31P and first guide 31 also can be located forward of the riser fastener, riser fastener hole, vertical fastener and vertical fastener hole. The first fastener 32 also can be oriented substantially vertically and optionally parallel to the vertical axis VA of the primary mount.

As previously mentioned, the mounting system 10 can include a horizontal micro adjuster 50 as well as the vertical micro adjuster 30. The horizontal micro adjuster 50 can be configured and can include elements similar or identical to that of the vertical micro adjuster 30. Accordingly, the horizontal micro adjuster 50 will only be described briefly here. The horizontal micro adjuster 50 can include a second threaded fastener 52 having a first end 52A and a second end 52B. The first end 52A can include a head H of the fastener. The fastener can be threaded along the shaft 52S. The second threaded fastener 52 can be aligned along a horizontal axis HA that is generally perpendicular to the vertical axis VA. The second fastener 52 can be generally perpendicular to the first fastener 32 of the vertical micro adjuster 30. The second fastener 52 can extend through respective apertures 46A and 46B defined by the secondary mount in a secondary mount arm 55 that extends away from the interior 401 of the secondary mount 40. A portion of this arm 55 can define the guide recess 44A that interfaces with the guide 24A of the primary mount. The horizontal micro adjuster also can include a control knob 53 that is secured to the second end 52B of the fastener. The control knob 53 can be fixedly secured to the second end 52B of the fastener 52 so that when the knob is rotated, the fastener also rotates about the horizontal axis HA.

Figure 2:
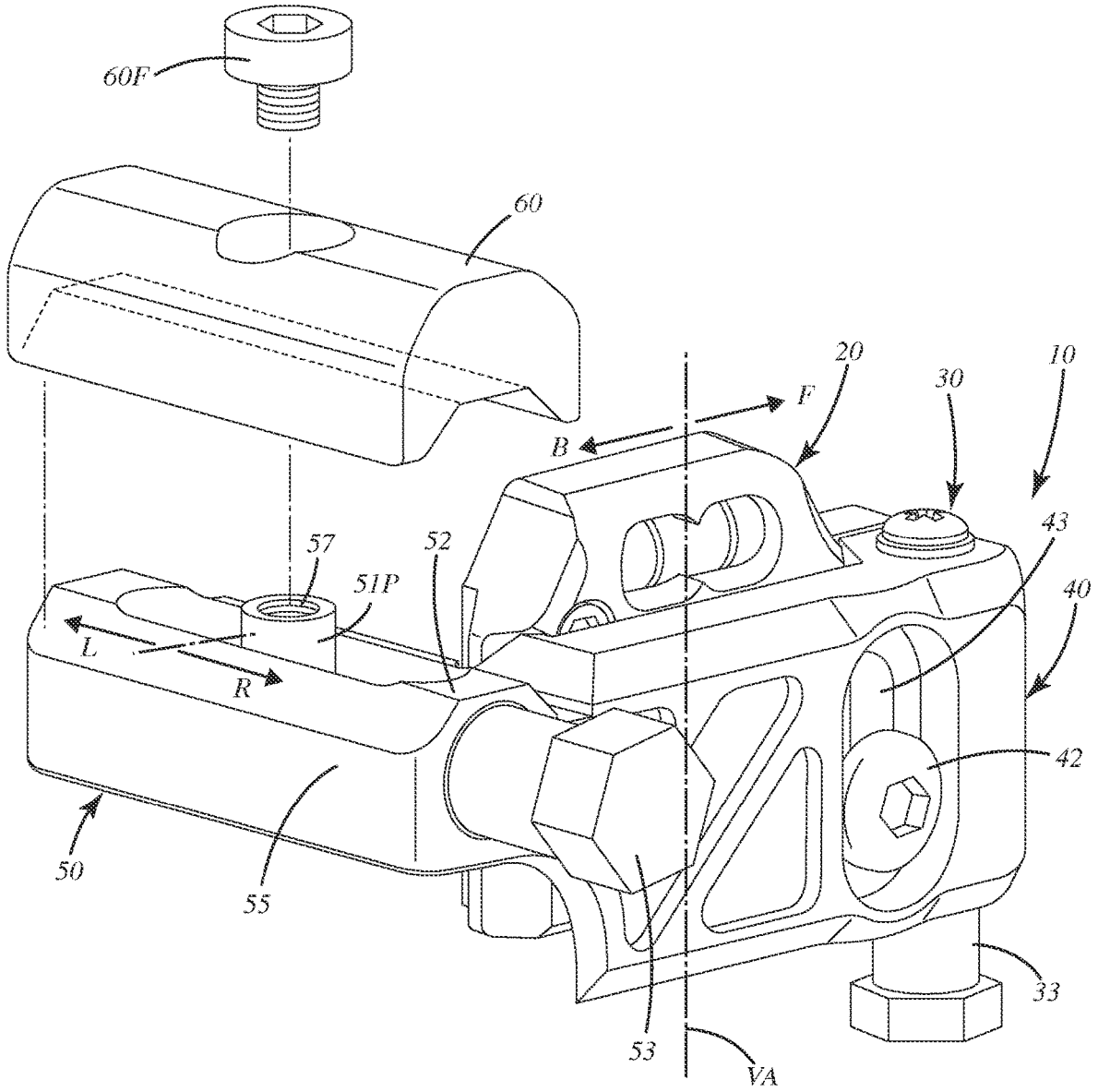
FIG. 2 is a perspective front view of the arrow rest mounting system.

The horizontal micro adjuster 30 can include a second pin or post 51P that is joined with the fastener 52 via a threaded hole 51H through which the fastener 52 projects. This post 51P can define an attachment portion 57 which as shown in FIGS. 2 and 4, can be in the form of another threaded hole that is perpendicular to the threaded hole 51H joining the post to the fastener 52. This attachment portion 57 can receive a fastener 60F associated with the arrow rest support 60. The fastener 60F can be threaded into the threaded hole 57 to mount the arrow rest support arm 60 to the secondary mount arm 55 in a movable manner using the horizontal micro adjuster 50. On a high level, rotation of the knob 53 by a user rotates the fastener 52 which in turn causes the rotational movement of the shaft to be translated to linear movement of the post 51P, the fastener 60F of the associated support arms 60, in a direction left L or in a direction right R as shown in FIG. 2. In turn, this can provide lateral or horizontal, for example, left or right adjustment and movement of the arrow rest support 60 as well as the associated support arm 62 that supports the arrow. The horizontal micro adjuster also thereby can provide selective horizontal adjustment of the arrow rest support and support arm relative to the bowstring plane BP within which the bowstring moves. As a result, the support 60 as well as the support arm 62 can move laterally toward, away or within the bowstring plane BP according to a user's preferences.

As noted above, the horizontal micro adjuster 50 can be mounted rearward B of the riser fastener 22, the riser fastener hole 23 as well as the vertical faster 42 and vertical fastener hole 43. The horizontal micro adjuster also can be mounted in the rearward portion 40R of the secondary mount. When installed on the bow riser 92 shown in FIG. 8, the horizontal micro adjuster 50 also can be mounted rearward B of the rear surface 92R of the riser 92 that extends above the shelf 92S. Of course, depending on the configuration of the riser, the horizontal micro adjuster 50 can be disposed in different locations on the riser and relative to the shelf 92S. Generally, the horizontal micro adjuster can provide horizontal left and right or windage adjustment of the support arm 62 relative to the bowstring plane BP.

A method of installing or mounting the arrow rest mounting system 10 to an archery bow 90 will now be described in further detail with reference to FIGS. 6-8. On a high level, the method can include mounting a primary mount 20 to the archery bow riser 92 with a riser fastener 22, and mounting a secondary mount 40 to the primary mount 20, optionally via a vertical sliding movement, so that a vertical micro adjuster 30 is disposed forward of the riser fastener 22 and a horizontal micro adjuster 50 is disposed rearward of the riser fastener 22.

More particularly, as shown in FIG. 6, a riser 92 is provided on a bow 90. The riser can include a side or lateral surface 92E. The primary mount 20 can be placed adjacent the lateral surface 92E, with the interior surface 201 of the mount facing toward the surface 92E. The surfaces can be placed against and can engage one another. The riser fastener 22 can be placed through the riser fastener hole 23. The head 22H of the riser fastener can rest against and engage the shelf or ledge 23C of the riser fastener hole 23. The shaft of the fastener can project through the hole 23 and into a corresponding threaded hole defined by the riser 92. The fastener can be tightened down to secure the primary mount against the riser 92. The bubble level 27B can be used to level the primary mount relative to the bow vertical axis BVA or relative to a horizontal plane. If included, a set screw 28S can be threaded into the set screw hole 28 and can engage the lateral surface 92E of the riser 92 to anchor the primary mount in a fixed position relative to the riser 92.

After the primary mount 20 is fully mounted to the riser 92, the secondary mount 40 can be installed relative to the primary mount. In particular, as shown in FIG. 7, the secondary mount 40, with the support 60 and associated arm 62 can be moved in direction V, which can be a vertical direction, generally parallel to the vertical axis VA of the primary mount 20 as well as generally parallel to the bow vertical axis BVA. The secondary mount 40 can be brought into contact with the primary mount, with the first rail 24A of the primary mount registering in the guide recess 44A of the secondary mount. With the first rail 24A registered in the guide recess 44A, the secondary mount can be pivoted, rotated or tilted inward, in direction R, generally pivoting about a pivot axis PA associated with the first rail or guide recess. This pivot axis PA can be parallel to the vertical axis VA of the primary mount 20. As this occurs, the interior surface 401 of the secondary mount can move toward and engage the exterior surface 20E of the primary mount. During the tilting in direction R, the post 31P of the vertical micro adjuster 30 also can register in one of the registration holes 26A-26C depending on the vertical orientation preferred by the user. Optionally, the post 31P projecting from the secondary mount can impair the secondary mount 40 from being installed purely in a direction V relative to the primary mount 20 because the pin can interfere with the vertical movement of the secondary mount. For this reason, the optional tilting in direction R can be used to install the secondary mount 40 relative to the primary mount 20 as shown in FIG. 7.

After the secondary mount 40 is tilted in direction R, the interior surface 401 is adjacent the exterior surface 20E of the primary mount, and the pin 31P is registered in the respective registration holes 26A-26C, the user can install the vertical fastener 42 through the vertical fastener hole 43 and into one of the vertical fastener holes 25A, 25B of the primary mount. The vertical fastener can be tightened and its head 42H can engage the ledge 43L to pull and/or clamp the secondary mount against the primary mount, thereby securing these components together. The riser fastener 22 also can be fully or partially concealed by the secondary mount, for example the plate or base 40P that extends between the vertical micro adjuster 30 and the horizontal micro adjuster 50.

Turning to FIG. 8, when the secondary mount 40 is installed relative to the primary mount, a user can use the vertical micro adjuster 30 and/or the horizontal micro adjuster 50 to adjust the location of the support arm 62 relative to the bowstring plane BP. For example, to adjust the support arm 62 vertically up or down, for elevation, a user can loosen the vertical fastener 22 slightly, which in turn allows the secondary mount 40 to be moved, slid or transitioned relative to the primary mount 20. This movement of the secondary mount can be a vertical movement, generally parallel to or aligned with the vertical axis VA of the primary mount and/or the bow vertical axis BVA. This movement can be achieved by the user engaging the control knob 33 of the vertical micro adjuster 30 and rotating it. Due to the rotation, the guide 31 moves relative to the first fastener 32, which again can be rearward of the riser fastener 22 and the riser fastener hole 23 of the primary mount. As this occurs, the secondary mount is vertically adjusted in directions up U or down D, depending on the direction of the rotation. As this occurs, the support arm 62 moves up or down relative to or within the bowstring plane BP to adjust the vertical orientation of the arrow 99 relative to the shelf 92S and/or the bowstring 94 to which it is nocked. After the secondary mount 40 is appropriately moved vertically, the vertical fastener 22 can be tightened such that the head 22H engages the shelf 23C and clamps the secondary mount against the primary mount under force once again so that the two elements cannot move relative to one another any further with the vertical micro adjuster. This process can be repeated iteratively until the appropriate vertical disposition or elevation is achieved for the support arm 62.

As another example, to adjust the location of the support arm 62 horizontally, that is, to adjust it for windage, in directions left L and/or right R, a user can engage the control knob 53 of the horizontal micro adjuster 50. There may or may not be another fastener to loosen and allow the movement of the support 60 relative to the arm 55 but if there is, that fastener can be loosened before the control knob is rotated. Rotation of the control knob 53 translates to rotation of the fastener 52 within the horizontal micro adjuster 50. As a result, the second guide 51 and the associated post 51P can move in directions L or R, generally horizontally or laterally relative to the riser 92. With this movement, the support 60 and the associated support arm 62 can move laterally, left and/or right relative to the bowstring plane BP. The user can perform these adjustments until the appropriate orientation and alignment of the support arm relative to the bowstring plane is achieved. This process can be repeated iteratively until the appropriate horizontal disposition or windage is achieved for the location of the support 60 and thus the support arm 62 relative to the bowstring plane BP.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An arrow rest mounting system comprising:

a primary mount including a vertical axis, a primary mount exterior surface, and an opposing primary mount interior surface configured to be placed adjacent a side surface of an archery bow riser, the primary mount defining a riser fastener hole configured to receive a riser fastener, and a first vertical fastener hole, the riser fastener hole including a first portion sized to receive a shaft of the riser fastener and a second portion sized to receive a head of the riser fastener such that the head does not protrude beyond the primary mount exterior surface when installed in the riser fastener hole;

a secondary mount joined with the primary mount and selectively slidable relative to the primary mount along the vertical axis when the primary mount is secured to the archery bow riser, the secondary mount extending over and concealing the riser fastener, the secondary mount defining a second vertical fastener hole;

a vertical fastener extending through the second vertical fastener hole and into the first vertical fastener hole to secure the secondary mount to the primary mount in a plurality of positions;

a vertical micro adjuster operably joined with the primary mount and the secondary mount to provide selective vertical adjustment of the secondary mount relative to the primary mount parallel to the vertical axis;

a horizontal micro adjuster extending from the secondary mount; and an arrow rest support joined with the horizontal micro adjuster and including a support arm movable from a support position to a rest position, the horizontal micro adjuster configured to provide selective horizontal adjustment of the arrow rest support relative to a bowstring plane within which a bowstring of an archery bow, to which the arrow rest mounting system is mounted, moves.

2. The arrow rest mounting system of claim 1, wherein the second vertical fastener hole is an elongated slot that extends parallel to the vertical axis, wherein the primary mount defines a third vertical fastener hole that is aligned with the elongated slot.

3. The arrow rest mounting system of claim 1,
wherein the vertical micro adjuster includes a first threaded fastener joined with a first control knob,
wherein the secondary mount includes a forward portion that faces forward when the primary mount is mounted to an archery bow, and a rearward portion that faces rearward, toward a user drawing the archery bow,
wherein the vertical micro adjuster is positioned in the forward portion.

4. The arrow rest mounting system of claim 3,
wherein the forward portion is forward of the riser fastener and the vertical fastener.

5. The arrow rest mounting system of claim 4,
wherein the primary mount includes a first rail,
wherein the secondary mount includes a guide recess parallel to the vertical axis,
wherein the first rail is slidably registered with the guide recess.

6. The arrow rest mounting system of claim 1,
wherein the vertical micro adjuster is forward of the riser fastener,
wherein the horizontal micro adjuster is rearward of the riser fastener.

7. The arrow rest mounting system of claim 1,
wherein the vertical micro adjuster includes a first threaded fastener rotatably mounted to the secondary mount,
wherein the primary mount defines a first registration hole,
wherein a first guide is mounted on the first threaded fastener and registered in the first registration hole,
wherein rotation of the first threaded fastener moves the first guide along the first threaded fastener, thereby translating the secondary mount up or down relative to the primary mount.

8. The arrow rest mounting system of claim 7,
wherein the horizontal micro adjuster includes a second threaded fastener rotatably mounted to the secondary mount, distal from the first threaded fastener,
wherein a second guide is mounted on the second threaded fastener,
wherein rotation of the second threaded fastener moves the guide along the second threaded fastener, thereby translating the arrow rest support left or right relative to the primary mount.

9. The arrow rest mounting system of claim 1,
wherein the first and second threaded fasteners are perpendicular to one another.

10. The arrow rest mounting system of claim 1,
wherein the vertical micro adjuster is forward of the riser fastener,
wherein the horizontal micro adjuster is rearward of the riser fastener,
wherein the vertical micro adjuster is forward of the vertical fastener,
wherein the horizontal micro adjuster is rearward of the vertical fastener.

11. An arrow rest mounting system comprising:
a primary mount mountable to an archery bow riser, the primary mount defining a riser fastener hole configured to receive a riser fastener;
a secondary mount movably joined with the primary mount;
a vertical micro adjuster operably joined with the primary mount and the secondary mount to provide selective vertical adjustment of the secondary mount relative to the primary mount;
a horizontal micro adjuster extending from the secondary mount; and
an arrow rest support joined with the horizontal micro adjuster and including a support arm movable from a support position to a rest position, the horizontal micro adjuster configured to provide selective horizontal adjustment of the support arm,
wherein the vertical micro adjuster is forward of the riser fastener hole,
wherein the horizontal micro adjuster is rearward of the riser fastener hole.

12. The arrow rest mounting system of claim 11,
wherein the primary mount includes a vertical axis,
wherein the secondary mount is selectively slidable relative to the primary mount along the vertical axis.

13. The arrow rest mounting system of claim 11,
wherein the vertical micro adjuster is configured to provide selective vertical adjustment of the secondary mount relative to the primary mount parallel to a vertical axis defined by the primary mount.

14. The arrow rest mounting system of claim 11,
wherein the vertical micro adjuster includes a first threaded fastener having a first end and a second end,
wherein the secondary mount includes a first aperture and a second aperture,
wherein the first end extends in the first aperture and the second end extends in the second aperture, with the first and second ends rotatable within the first and second apertures,
wherein the first threaded fastener is disposed forward of the riser fastener and the riser fastener hole when the primary mount is mounted on the riser.

15. The arrow rest mounting system of claim 14,
wherein the horizontal micro adjuster includes a second threaded fastener having a third end and a fourth end,
wherein the secondary mount includes a third aperture and a fourth aperture,
wherein the third end extends in the third aperture and the fourth end extends in the fourth aperture, with the third and fourth ends rotatable within the third and fourth apertures,
wherein the second threaded fastener is disposed rearward of the first fastener, the riser fastener and the riser fastener hole when the primary mount is mounted on the riser.

16. The arrow rest mounting system of claim 11,
wherein the riser fastener hole includes an enlarged portion within which a head of the riser fastener nests,
wherein the secondary mount covers and conceals the head of the riser fastener.

17. The arrow rest mounting system of claim 11,
wherein the primary mount defines a first vertical fastener hole;
wherein the secondary mount defines a second vertical fastener hole aligned with the first vertical fastener hole,
wherein a vertical fastener extends through the second vertical fastener hole and into the first vertical fastener hole,
wherein the vertical fastener is slidable linearly relative to the second fastener hole to adjust a vertical position of the secondary mount relative to the primary mount with the vertical micro adjuster.

18. A method of mounting an arrow rest mounting system to an archery bow, the method comprising:
mounting a primary mount to an archery bow riser with a riser fastener; and mounting a secondary mount to the primary mount so that a vertical micro adjuster is disposed forward of the riser fastener and a horizontal micro adjuster is disposed rearward of the riser fastener.

19. The method of claim 18 comprising:

moving the secondary mount along a vertical axis of the primary mount; and concealing the riser fastener under the secondary mount.

20. The method of claim 19 comprising:

rotating a first fastener in a vertical orientation rearward of the riser fastener with a control knob located rearward of the riser fastener to vertically adjust the secondary mount up or down relative to the primary mount; and rotating a vertical fastener after rotating the first fastener step to secure the primary mount in a fixed position relative to the primary mount.

* * * * *